US010490071B2

(12) United States Patent
Sakuma et al.

(10) Patent No.: US 10,490,071 B2
(45) Date of Patent: Nov. 26, 2019

(54) TRAFFIC LIGHT INFORMATION PROVIDING SYSTEM AND TRAFFIC LIGHT INFORMATION PROVIDING METHOD, AND SERVER USED THEREFOR

(71) Applicant: TOYOTA JIDOSHA KABUSHIKI KAISHA, Toyota-shi, Aichi-ken (JP)

(72) Inventors: Satoru Sakuma, Nagakute (JP); Shuhei Yamamoto, Aichi-ken (JP); Munehiro Kamiya, Anjo (JP); Hideo Hasegawa, Nagoya (JP); Shinji Kurachi, Nagoya (JP); Tomoya Shimizu, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/160,136

(22) Filed: Oct. 15, 2018

(65) Prior Publication Data

US 2019/0122548 A1 Apr. 25, 2019

(30) Foreign Application Priority Data

Oct. 19, 2017 (JP) ..... 2017-202799

(51) Int. Cl.

| | |
|---|---|
| ***G08G 1/08*** | (2006.01) |
| ***G08G 1/096*** | (2006.01) |
| ***G08G 1/01*** | (2006.01) |
| ***G08G 1/0967*** | (2006.01) |
| ***G08G 1/095*** | (2006.01) |
| ***G08G 1/07*** | (2006.01) |

(52) U.S. Cl.

CPC ..... *G08G 1/096* (2013.01); *G08G 1/0112* (2013.01); *G08G 1/0133* (2013.01); *G08G 1/0145* (2013.01); *G08G 1/07* (2013.01); *G08G 1/08* (2013.01); *G08G 1/095* (2013.01); *G08G 1/096716* (2013.01); *G08G 1/096741* (2013.01); *G08G 1/096775* (2013.01)

(58) Field of Classification Search

CPC ..... G08G 1/096; G06F 17/00

USPC ..... 340/932, 901, 903, 905, 907, 929; 701/70, 93

See application file for complete search history.

(56) References Cited

U.S. PATENT DOCUMENTS 6,396,417 B2 * 5/2002 Lee ..... G08G 1/087 340/904

9,384,659 B2 * 7/2016 Tsuda ..... G08G 1/0112

(Continued)

FOREIGN PATENT DOCUMENTS

WO 2014115309 A1 7/2014

*Primary Examiner* — Tai T Nguyen

(74) *Attorney, Agent, or Firm* — Hunton Andrews Kurth LLP

(57) ABSTRACT

A traffic light information providing system includes a vehicle and a server configured to communicate with the vehicle, and provides information on change in color of a traffic light to the vehicle. The vehicle transmits to the server, vehicle data including time information and position information of the vehicle at the time when the vehicle resumes running from a state of stop at an intersection. The server operates and stores a period of change from the red light to the green light of a traffic light provided at the intersection based on the vehicle data. The server transmits information indicating timing of change to the green light of the traffic light based on the stored period of change, to a vehicle which approaches the intersection.

7 Claims, 8 Drawing Sheets

(56) References Cited

U.S. PATENT DOCUMENTS

| | | | | |
|---|---|---|---|---|
| 9,623,873 | B2 * | 4/2017 | Tosaka | B60W 30/1886 |
| 9,956,955 | B2 * | 5/2018 | Oguri | B60T 7/18 |
| 2007/0222638 | A1 * | 9/2007 | Chen | G08G 1/095 340/901 |
| 2012/0026014 | A1 * | 2/2012 | Miller | G08G 1/07 340/929 |
| 2015/0262483 | A1 | 9/2015 | Sugawara | |

* cited by examiner

| VEHICLE POSITION | TIME AND DAY | DAY OF WEEK | STANDING TIME (sec) |
|---|---|---|---|
| (X1, Y1, Z1) | 2017/10/1 08:12:34 | SUN | 30 |
| (X2, Y2, Z2) | 2017/10/2 13:00:20 | MON | 20 |
| (X3, Y3, Z3) | 2017/10/4 20:15:46 | WED | 33 |
| (X4, Y4, Z4) | 2017/10/5 10:32:11 | THU | 15 |

FIG.6

TRAFFIC LIGHT ID : 1234

| DATE | TIME |
|---|---|
| 2017/10/8 | 13:20:15 |
| | 13:23:30 |
| | 13:27:05 |
| | 13:30:45 |
| | 13:33:50 |
| | 13:30:05 |

TRAFFIC LIGHT ID : 1234

| MONTH | DAY OF WEEK | TIME OF DAY | PERIOD |
|---|---|---|---|
| OCTOBER | MON | 00:00～01:00 | T1 |
| | | 01:00～02:00 | T2 |
| | | 02:00～03:00 | T3 |
| | | | |
| | | 22:00～23:00 | T23 |
| | | 23:00～24:00 | T24 |

| TRAFFIC LIGHT ID | PREDICTED TIME OF CHANGE |
|---|---|
| 1234 | 2017/10/10 10:00:00 |
| | 2017/10/10 10:03:00 |
| | 2017/10/10 10:06:00 |
| | 2017/10/10 10:09:00 |
| | 2017/10/10 10:12:00 |
| | 2017/10/10 10:15:00 |

TRAFFIC LIGHT INFORMATION PROVIDING SYSTEM AND TRAFFIC LIGHT INFORMATION PROVIDING METHOD, AND SERVER USED THEREFOR

This nonprovisional application is based on Japanese Patent Application No. 2017-202799 filed with the Japan Patent Office on Oct. 19, 2017, the entire contents of which are hereby incorporated by reference.

BACKGROUND

Field

The present disclosure relates to a traffic light information providing system and a traffic light information providing method as well as a server used therefor and more particularly to a technique of providing information on change in color of a traffic light to a vehicle.

Description of the Background Art

A green wave drive support system has been known that aims at reduction in energy loss and CO2 emission by suppressing acceleration and deceleration involved with stop at the red light by giving a notification about a speed at which a vehicle can pass a next intersection on the green light during running.

International Publication WO2014/115309 discloses a movement assistance system configured to present a remaining lighting time of a traffic light based on traffic light information obtained by using a post service of a social networking service (SNS).

SUMMARY

In a conventionally available drive support system based on road-vehicle communication, a road-side device for transmitting traffic light information to a vehicle should be provided at each intersection where a traffic light is provided. Therefore, construction of a system has highly been costly and it has been difficult to realize the system.

In the system disclosed in International Publication WO2014/115309, traffic light information is obtained by using a post service of an SNS. Therefore, a road-side device to be provided around an intersection as above is not necessary and provision of movement assistance which is highly accurate by using latest information posted to an SNS server can be expected.

The system disclosed in International Publication WO2014/115309, however, requires information on a picked-up image of a traffic light posted to an SNS site. Therefore, when nobody posts information on a picked-up image, a period of change in color of a traffic light cannot be specified.

The present disclosure was made to solve such problems, and an object thereof is to provide a traffic light information providing system and a traffic light information providing method capable of providing drive support by specifying a period of change of a traffic light without introducing a new device.

A traffic light information providing system according to the present disclosure provides information on change in color of a traffic light to a vehicle. The traffic light information providing system includes a vehicle and a server configured to communicate with the vehicle. The vehicle is configured to transmit to the server, vehicle data including time information and position information of the vehicle when the vehicle resumes running from a state of stop at an intersection. The server is configured to (a) operate and store a period of change from a red light to a green light of a traffic light provided at the intersection based on the vehicle data and (b) transmit information indicating timing of change of the traffic light to the green light based on the stored period of change, to a vehicle which approaches the intersection.

The vehicle is configured to transmit the vehicle data to the server when a vehicle speed exceeds a threshold value from the state of stop at the red light at the intersection.

According to the traffic light information providing system in the present disclosure, the server operates a period of change of a traffic light provided at an intersection based on vehicle data including time information and position information of a vehicle at the time when the vehicle resumes running from a state of stop at the intersection. Though timing of transmission of the vehicle data from the vehicle is determined based on position information of the vehicle and a vehicle speed, such information can be obtained from devices generally provided in vehicles. Vehicle data to be transmitted is also configured with information from devices generally provided in vehicles. Therefore, the traffic light information providing system according to the present disclosure can specify a period of change of a traffic light without introducing a new device. Cost for constructing a system can thus be suppressed.

The vehicle is configured to transmit the vehicle data to the server when the vehicle resumes running from a state that the vehicle is at the head of vehicles which stop at the intersection.

Timing of resumption of running by a vehicle at the head of vehicles which stop at the red light at an intersection is not affected by a preceding vehicle. Therefore, a time lag between timing of change of a traffic light from the red light to the green light and timing of resumption of running of the vehicle at the head is less than a time lag of other vehicles. Therefore, accuracy in operation of the period of change can be enhanced by using vehicle data at the timing of resumption of running of the vehicle located at the head of vehicles which stop at an intersection.

The server is configured to identify a traffic light based on the position information and to operate the period of change of the traffic light based on the time information accumulated for each identified traffic light.

According to such a configuration, a period of change can statistically be estimated in consideration of accumulated past data. Accuracy in operation of the period of change can thus be enhanced.

The server is configured to operate a predicted time of change of the traffic light to the green light based on latest time information on change of the traffic light to the green light and the operated period of change, and transmit the predicted time to the vehicle which approaches the intersection.

According to such a configuration, subsequent time of change to the green light can be predicted in consideration of latest time of change to the green light. Accuracy in subsequent timing of change to the green light of which notification should be given to a user can be enhanced.

The server is configured to operate and store the period of change of the identified traffic light in accordance with at least any one category of a month, a day of a week, and a time of a day.

According to such a configuration, by finely setting a time segment for each traffic light, accuracy in operation of a period of change can be enhanced and accuracy in predicted time of change of the traffic light can be enhanced.

A traffic light information providing method according to another aspect of the present disclosure is a method of providing information on change in color of a traffic light in a system including a vehicle and a server configured to communicate with the vehicle. The traffic light information providing method includes (a) transmitting to the server, vehicle data including time information and position information of the vehicle when the vehicle resumes running from a state of stop at an intersection, (b) operating and storing a period of change from a red light to a green light of a traffic light provided at the intersection based on the vehicle data, and (c) transmitting information indicating timing of change of the traffic light to the green light based on the stored period of change, to a vehicle which approaches the intersection.

A server according to yet another aspect of the present disclosure is included in a traffic light information providing system for providing information on change in color of a traffic light to a vehicle. The server is configured to communicate with a vehicle. The server is configured to (a) receive vehicle data including time information and position information of the vehicle when the vehicle resumes running from a state of stop at an intersection, (b) operate and store a period of change from a red light to a green light of a traffic light provided at the intersection based on the vehicle data, and (c) transmit information indicating timing of change of the traffic light to the green light based on the stored period of change, to a vehicle which approaches the intersection.

According to the present disclosure, a traffic light information providing system can specify a period of change of a traffic light based on position information of a vehicle obtained by using GPS and vehicle speed information obtained from a vehicle speed sensor. Therefore, a period of change of a traffic light can be specified without introducing a new device. Cost for constructing a system can thus be suppressed.

The foregoing and other objects, features, aspects and advantages of the present disclosure will become more apparent from the following detailed description of the present disclosure when taken in conjunction with the accompanying drawings.

BRIEF DESCRIPTION OF THE DRAWINGS

FIG. 6 is a first diagram for illustrating an approach to operate a period of change of a traffic light.

DESCRIPTION OF THE PREFERRED EMBODIMENTS

Figure 1:
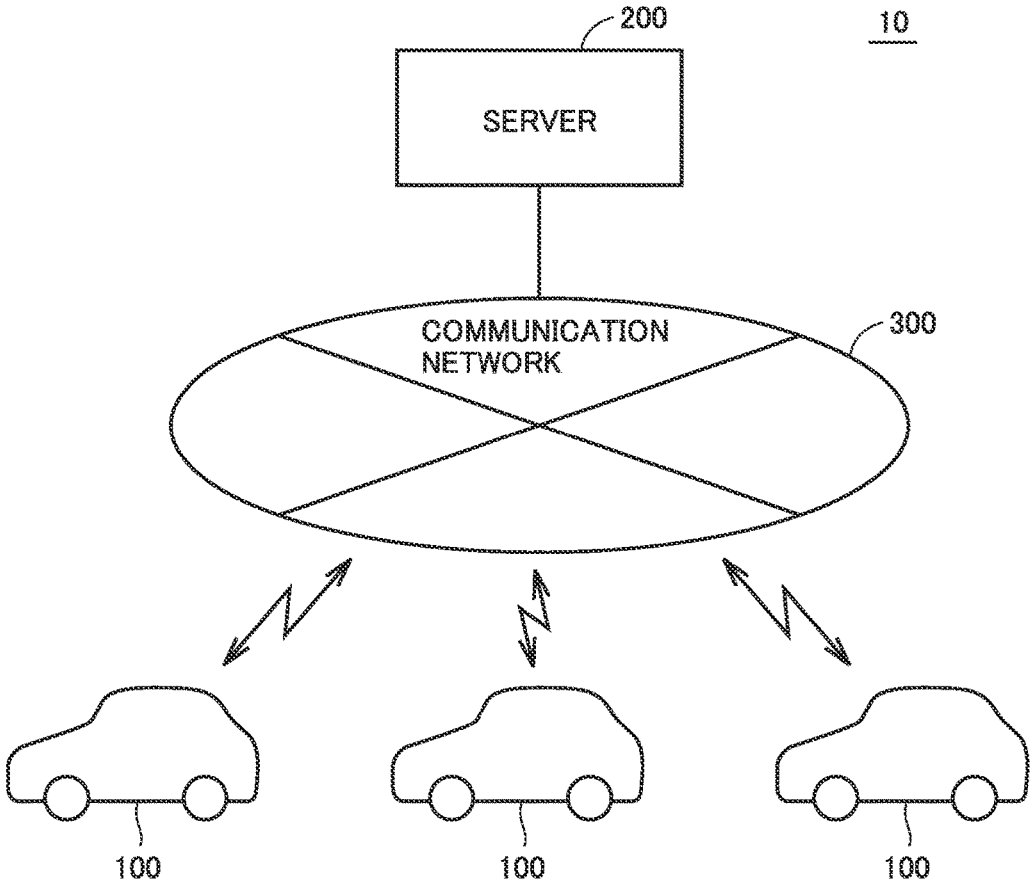
FIG. 1 is a diagram schematically showing an overall configuration of a traffic light information providing system according to the present embodiment.

An embodiment of the present disclosure will be described in detail below with reference to the drawings. The same or corresponding elements in the drawings have the same reference characters allotted and description thereof will not be repeated.

FIG. 1 is a diagram schematically showing an overall configuration of a traffic light information providing system 10 according to the present embodiment. Referring to FIG. 1, traffic light information providing system 10 includes a plurality of vehicles 100 (which are also simply referred to as a "vehicle" below) and a server 200 which can communicate with vehicle 100. Vehicle 100 and server 200 are configured to transmit and receive information to and from each other through a communication network 300 such as the Internet or telephone lines. Vehicle 100 and server 200 may directly communicate with each other, not via communication network 300.

In traffic light information providing system 10, server 200 operates a period of change of a color of a traffic light provided at each intersection based on information obtained from vehicle 100 and transmits to vehicle 100, time information at which the traffic light will change to the green light next time. In vehicle 100, time information transmitted from server 200 is given to a driver so that drive support is provided to decrease deceleration for the red light or avoid stop at the red light. Thus, it can be made to contribute to reduction in energy loss and CO2 emission involved with deceleration and stop can be made.

(Configuration of Vehicle and Server)

Figure 2:
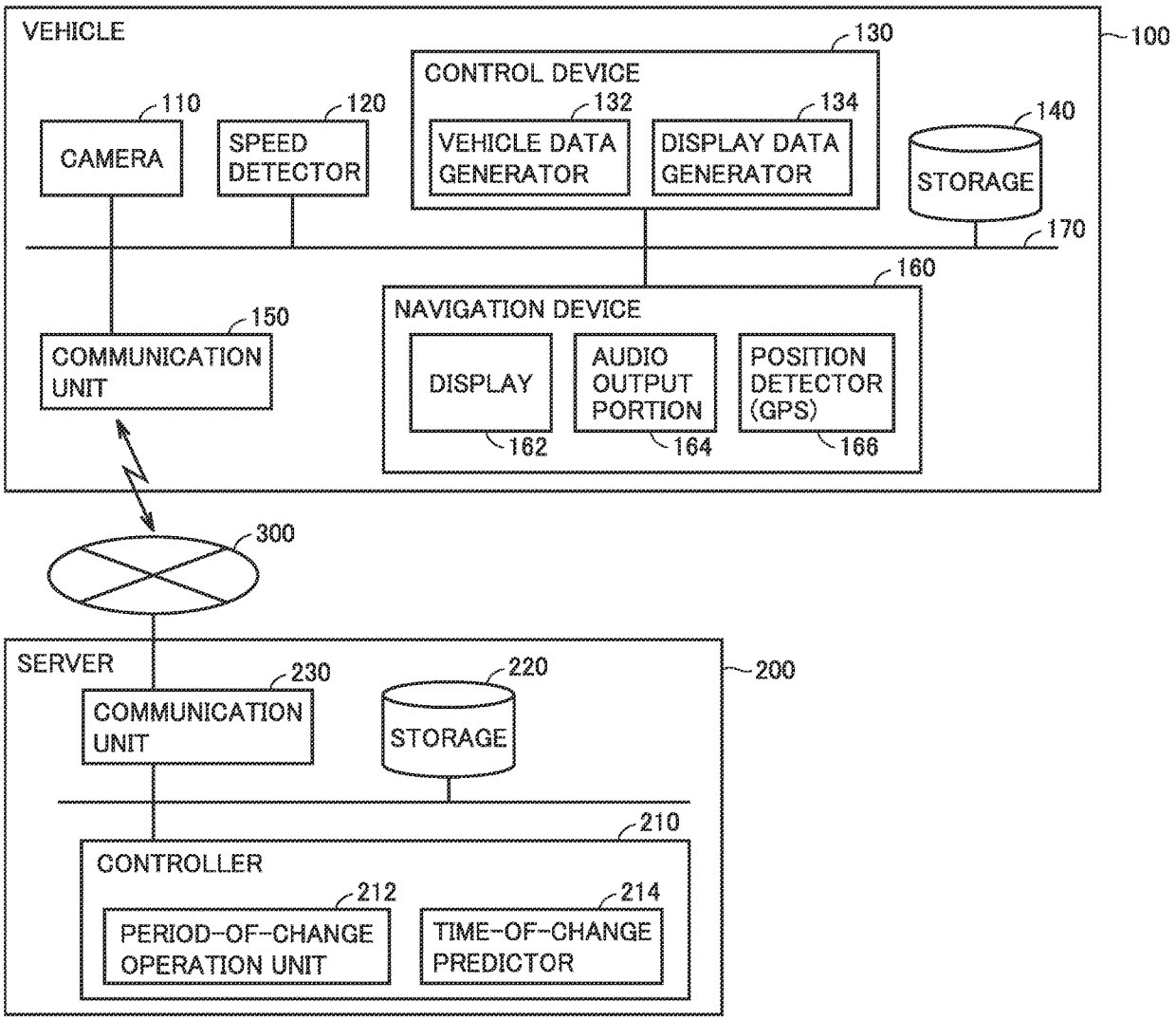
FIG. 2 is a block diagram for illustrating details of a vehicle and a server in FIG. 1.

FIG. 2 is a block diagram for illustrating details of vehicle 100 and server 200 in FIG. 1. Referring to FIG. 2, vehicle 100 includes a camera 110, a speed detector 120, a control device 130, a storage 140, a communication unit 150, and a navigation device 160. These devices are configured to transmit and receive information to and from one another through a data bus 170.

Communication unit 150 is a communication interface between vehicle 100 and communication network 300. Vehicle 100 transmits and receives information to and from server 200 through communication unit 150.

Camera 110 is implemented, for example, by a charge coupled device (CCD) camera and attached to a position at which the camera can shoot video forward of vehicle 100. Camera 110 is mounted, for example, as a part of a dashboard camera for recording video at the time when vehicle 100 encounters an accident. The video shot with camera 110 is transmitted to server 200 through communication unit 150.

Speed detector 120 detects a running speed of vehicle 100. Speed detector 120 may be a rotation sensor for detecting a rotation speed of wheels or a speed sensor which uses laser beams.

Navigation device 160 includes a display 162, an audio output portion 164, and a position detector 166. Display 162 is implemented, for example, by a liquid crystal panel and shows a position of vehicle 100 on map information stored in storage 140 or shows guidance on a route to a destination. When a touch panel function is provided to display 162, display 162 also functions as an input unit which accepts an operation by a user. Audio output portion 164 outputs through voice and sound, guidance on a route, an alarm at the time of occurrence of an abnormal condition, or advice to a user during running.

Position detector 166 obtains absolute position information of vehicle 100 by using a global positioning system (GPS). Navigation device 160 shows a position of vehicle 100 on display 162 based on the obtained position information. Position detector 166 outputs obtained position information to server 200.

Control device 130 includes a central processing unit (CPU), a storage device such as a memory, and an input and output buffer, none of which is shown, and controls entire vehicle 100 in a centralized manner. Control device 130 includes a vehicle data generator 132 and a display data generator 134.

Vehicle data generator 132 generates data on timing of change in color of a traffic light provided at an intersection (which is also referred to as "vehicle data" below) and transmits the vehicle data to server 200. As will be described later, server 200 operates a period of change of the traffic light from the red light to the green light based on the vehicle data from vehicle 100, and predicts time of change of the traffic light to the green light based on the period of change.

Display data generator 134 receives information on time of change to the green light predicted by server 200 and generates data for representation on display 162 of navigation device 160.

Server 200 includes a controller 210, a storage 220, and a communication unit 230. Controller 210 includes a period-of-change operation unit 212 and a time-of-change predictor 214.

Communication unit 230 is a communication interface between server 200 and communication network 300. Server 200 transmits and receives information to and from vehicle 100 through communication unit 230.

Controller 210 includes a central processing unit (CPU), a storage device such as a memory, and an input and output buffer, none of which is shown. Controller 210 includes period-of-change operation unit 212 and time-of-change predictor 214. Period-of-change operation unit 212 operates a period of change of a traffic light provided at an intersection from the red light to the green light based on information included in the vehicle data transmitted from vehicle 100. The operated period of change is stored in storage 220 for each traffic light.

When approach of vehicle 100 to an intersection is sensed, time-of-change predictor 214 predicts time of change to the green light of the traffic light provided at the intersection based on data on the period of change stored in storage 220 and transmits the predicted time to vehicle 100.

Vehicle 100 shows the predicted time obtained from server 200 on display 162 of navigation device 160 and notifies a user of the predicted time. Alternatively, vehicle 100 may give a notification about a recommended speed at which the vehicle will be able to pass the intersection on the green light at the time of arrival at the intersection based on the obtained predicted time and a position of vehicle 100. Deceleration or stop of vehicle 100 by a user for the red light of the traffic light at the time of arrival of vehicle 100 at the intersection can thus be decreased so that energy loss and $CO_2$ emission can be reduced.

(Description of Contents of Control)

In such a system capable of what is called green wave drive support, information on a traffic light at each intersection should be collected. In a conventionally available system, a road-side device for transmitting information on a traffic light to a vehicle should be provided at each intersection provided with a traffic light. Therefore, cost for constructing infrastructures for construction of the system has been high and it has been difficult to realize the system.

In the present embodiment, an approach to operate a period of change of a traffic light at each intersection from the red light to the green light based on position information and vehicle speed information of a vehicle which have conventionally been used in vehicles, and to predict a future time of change to the green light based on the operated period of change is adopted.

Specifically, when vehicle data generator 132 of vehicle 100 detects resumption of running from a state of stop of vehicle 100 at an intersection (that is, a vehicle speed has attained to a prescribed threshold value $\alpha$ km/h (>0)) based on map information and position information of vehicle 100 obtained by navigation device 160 and vehicle speed information from speed detector 120, time information and position information of vehicle 100 at that time are transmitted to server 200.

A state of stop of vehicle 100 at an intersection is generally considered as being attributed to the red traffic light at the intersection. In many cases, running is resumed from that state at timing of change from the red light to the green light of the traffic light. Therefore, in the present embodiment, timing of resumption of running from the state of stop of vehicle 100 at an intersection is regarded as timing of change of the traffic light at the intersection from the red light to the green light, so that timing of change in color of the traffic light can be detected with an existing device without performing complicate processing such as image analysis.

It is preferable to transmit vehicle data, when vehicle stops at the head of a plurality of vehicles which stop as waiting for a traffic light at an intersection (that is, a position closest to the intersection). If another vehicle stops ahead of vehicle 100, vehicle 100 is unable to immediately start running even though the traffic light changes from the red light to the green light, and there is a time lag between timing of actual change of the traffic light and timing of start of vehicle 100.

Processing performed in vehicle 100 and server 200 in traffic light information providing system 10 in the present embodiment will be described below in further detail.

Figure 3:
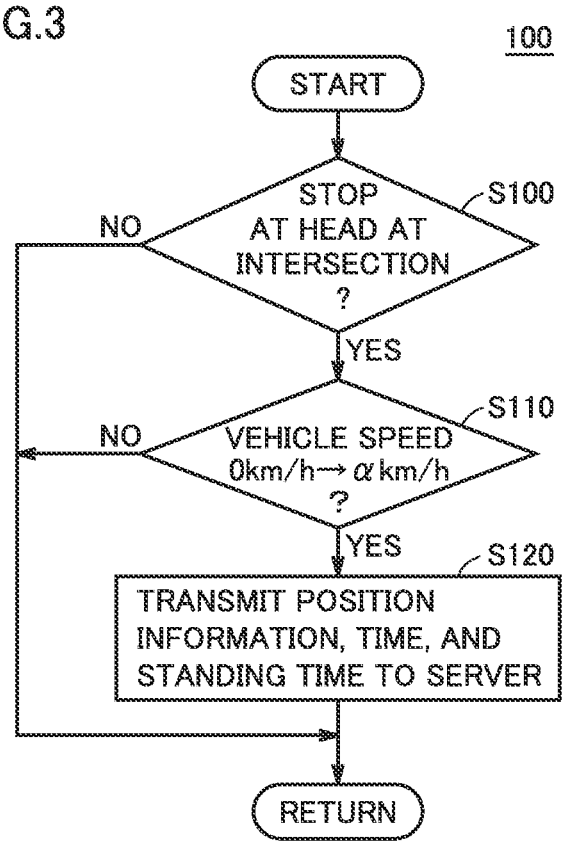
FIG. 3 is a flowchart for illustrating processing for transmitting vehicle data from a vehicle to the server.

FIG. 3 is a flowchart for illustrating processing for transmitting vehicle data from vehicle 100 to server 200. Flowcharts shown in FIG. 3 and FIGS. 5 and 9 which will be described later are executed as a result of calling of a program stored in control device 130 of vehicle 100 or controller 210 of server 200 from a main routine every prescribed period or when a prescribed condition is satisfied. Alternatively, some or all of steps in the flowcharts can also be processed by dedicated hardware (electronic circuits).

Referring to FIG. 3, vehicle 100 determines in step (which is abbreviated as S below) 100, whether or not vehicle 100 stops at the head of vehicles which stop at an intersection. Such determination can be made, for example, based on a distance from the intersection to vehicle 100. Alternatively, absence of a vehicle ahead of vehicle 100 may be detected based on video from camera 110 or information from a not-shown ultrasonic sensor.

When vehicle 100 is not at the head of vehicles (NO in S100), subsequent processing is skipped and the process ends. When vehicle 100 is at the head of vehicles (YES in S100), the process proceeds to S110 and vehicle 100 determines whether or not a vehicle speed has increased to a prescribed threshold value (α km/h) from a state of stop (=0 km/h), that is, running has been resumed from the state of stop. When a vehicle speed is lower than the threshold value (NO in S110), vehicle 100 remains stopped or runs at a low speed as creeping and running has not yet been resumed. Therefore, processing in step S120 is skipped and the process ends.

When the vehicle speed is higher than the threshold value and running has been resumed (YES in S110), vehicle 100 determines that the traffic light has changed from the red light to the green light and the process proceeds to S120. In S120, vehicle 100 transmits vehicle data including time and position information of the vehicle at that time to server 200.

Figures 4, 5:
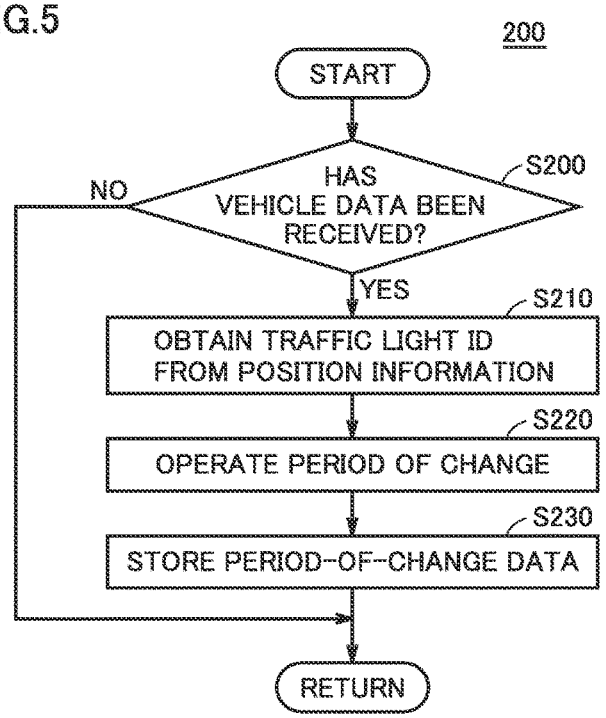
FIG. 4 is a diagram showing exemplary vehicle data transmitted from the vehicle to the server in FIG. 3.
FIG. 5 is a flowchart for illustrating processing for operating a period of change of a traffic light performed in the server.

FIG. 4 is a diagram showing exemplary vehicle data obtained by server 200. Referring to FIG. 4, the vehicle data includes a position of a vehicle (vehicle position), time and day, and a day of a week. In a coordinate (X, Y, Z) shown in the field of vehicle position, X represents a longitude, Y represents a latitude, and Z represents an altitude. A standing time of vehicle 100 at an intersection and video from camera 110 while the vehicle remains stopped may also be transmitted together as the vehicle data.

An example in which data is not transmitted to server 200 when vehicle 100 is not a vehicle at the head is shown for step S100. When vehicle 100 is not a vehicle at the head, however, time of resumption of running may be corrected in accordance with a distance from an intersection to a stop position and then vehicle data may be transmitted to server 200.

Processing for operating a period of change of a traffic light performed in server 200 will now be described with reference to FIGS. 5 to 8. FIG. 5 is a flowchart of processing for operating a period of change performed in server 200.

Referring to FIG. 5, server 200 determines in S200 whether or not it has received vehicle data from vehicle 100. When the server has not received vehicle data (NO in S200), subsequent processing is skipped and the process ends.

When the vehicle data has been received (YES in S200), the process proceeds to S210 and server 200 obtains position information from the received vehicle data and specifies an intersection where vehicle 100 has stopped. Storage 220 of server 200 stores in advance information representing correspondence between an intersection and a traffic light provided at the intersection. Server 200 obtains an identifier of the traffic light provided at the intersection where vehicle 100 has stopped (which is also referred to as a "traffic light ID" below) based on this information.

In step S220, server 220 operates a period of change of the traffic light to the green light based on the time information obtained from vehicle 100 and most recent time information stored in storage 220 for the specified traffic light ID.

Server 200 generates data in which latest time information obtained from vehicle 100 and past time information stored in storage 220 are chronologically arranged (FIG. 6) and operates a difference between adjacent times (that is, a period of change from previous change to the green light to present change to the green light). Timing to start running of a vehicle by a user may vary depending on circumstances of the surroundings or user's attention. Therefore, the period found based on the difference in time as above may also vary. Therefore, server 200 operates a period of change of the traffic light in a statistic approach based on the operated period. Specifically, server 200 generates a distribution (a histogram) of operated periods (FIG. 7) and operates a period of change T of the traffic light based, for example, on an average value or a median value (a median) in the histogram.

Figures 7, 8:
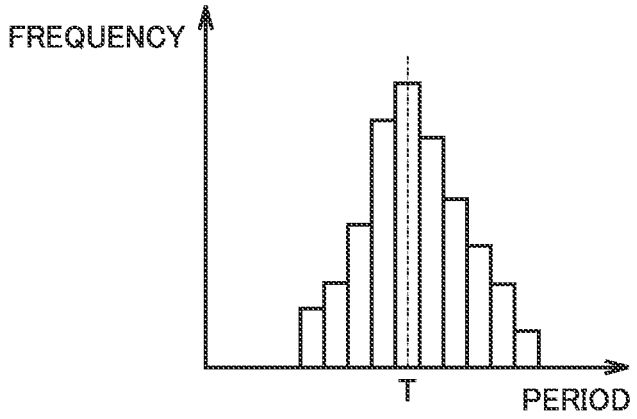
FIG. 7 is a second diagram for illustrating an approach to operate a period of change of a traffic light.
FIG. 8 is a diagram showing exemplary period-of-change data generated in FIG. 5.

Server 200 stores in S230, the operated period of change for each traffic light ID as a map divided into months, days of a week, and times of a day as in an example shown in FIG. 8. By thus storing the period of change for each category, time of change of the traffic light of which period of change is set differently for each season, each day of a week, and each time of a day can also appropriately be predicted. The category for storage of periods of change is not limited to those shown in FIG. 8 and another category may be adopted.

A configuration for predicting time of change of a traffic light which a vehicle will reach in the near future based on the stored period of change and notifying the vehicle of the predicted next time of change (the predicted time of change) will now be described.

Figure 9:
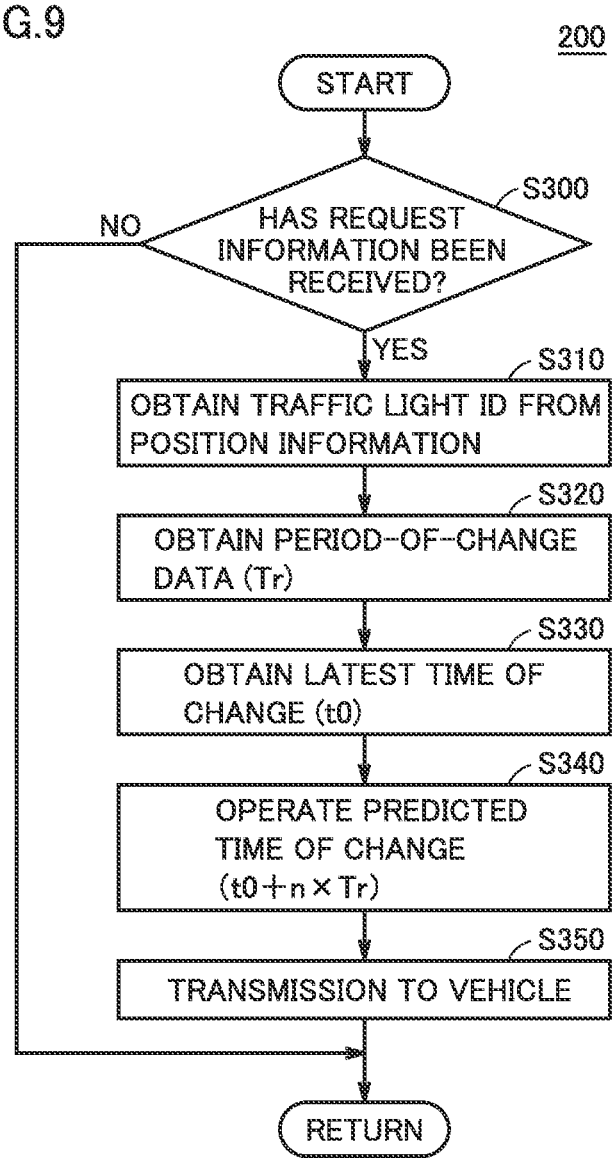
FIG. 9 is a flowchart for illustrating processing for operating a predicted time of change of a traffic light performed in the server.

FIG. 9 is a flowchart for illustrating processing for operating a predicted time of change of a traffic light performed in server 200.

Referring to FIG. 9, server 200 determines in S300 whether or not it has received request information on a predicted time of change of a traffic light from vehicle 100. The request information is transmitted from vehicle 100 to server 200 when vehicle 100 approaches an intersection on a route. This request information includes information for identifying vehicle 100, position information of an intersection, and information on a predicted time at which vehicle 100 will reach the intersection. The request information is generated by vehicle data generator 132 based on data obtained from navigation device 160 of vehicle 100.

When no request information has been received (NO in S300), subsequent processing is skipped and the process ends. When the request information has been received (YES in S300), the process proceeds to S310 and server 200 obtains a traffic light ID of a traffic light provided at an intersection from storage 220 based on position information of the intersection included in the request information.

Server 200 obtains in S320, period-of-change data Tr of the traffic light with the obtained traffic light ID by referring to the map stored in storage 220 (FIG. 8). Server 200 obtains latest data t0 on time of change of the traffic light to the green light from storage 220 (S330). Server 200 operates a predicted time of change after the current time point ($t0+n\times Tr$) based on obtained period-of-change data Tr and latest time of change t0 (S340), where n represents an integer not smaller than 1. n=1 represents a next predicted time of change and n=2 represents a predicted time of change after the next.

Figures 10, 11:
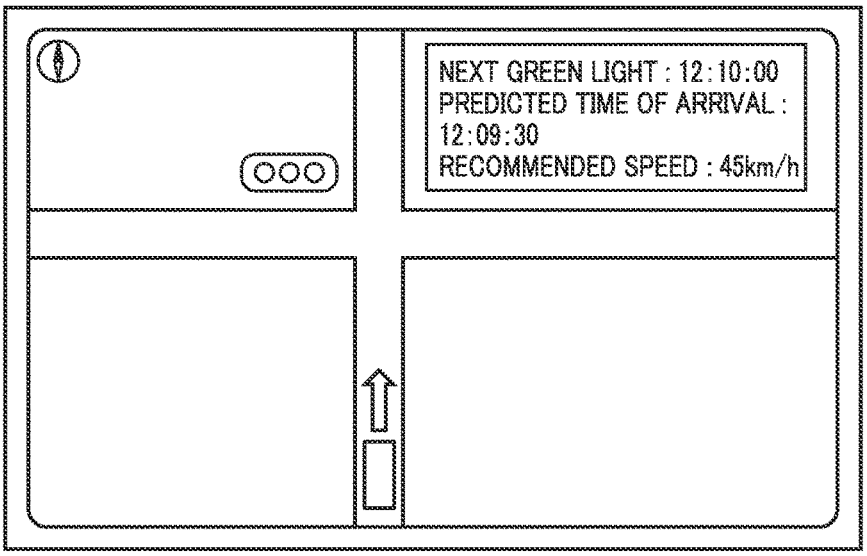
FIG. 10 is a diagram showing exemplary data on a predicted time of change of a traffic light transmitted from the server to a vehicle.
FIG. 11 is a diagram showing exemplary representation on a navigation device of a vehicle.

Thereafter, server 200 transmits in S350 to vehicle 100, information on the predicted time of change in connection with the traffic light ID as shown in FIG. 10.

In vehicle 100, information on the predicted time of change transmitted from server 200 is shown on display 162 of navigation device 160. FIG. 11 is a diagram showing exemplary representation on display 162 of navigation device 160. Referring to FIG. 11, display 162 shows a predicted time when a traffic light which vehicle 100 approaches will turn green next time and a predicted time when vehicle 100 will reach the intersection.

For example, in FIG. 11, a predicted time when the traffic light will turn to green next time is twelve ten and zero second and a predicted time when vehicle 100 will reach an intersection where the traffic light is provided is twelve nine and thirty seconds. In this example, with a current vehicle speed being maintained, the traffic light has not yet turned to green at a time point when the vehicle reaches the intersection and the vehicle is predicted to stop at the red light for approximately thirty seconds. In this case, for example, by slightly decelerating vehicle 100 and delaying time to reach the intersection, a user can pass the intersection on the green light.

A recommended vehicle speed may also be shown on display 162 for passing the intersection on the green light at the time when the vehicle reaches the intersection.

As set forth above, in a signal information providing system in the present embodiment, timing of resumption of running from a state of stop of a vehicle at an intersection is regarded as timing of change of a traffic light to the green light and information on the vehicle at that time is collected by the server. A period of change of each traffic light is thus specified. Information transmitted from a vehicle can be obtained with a position detection function provided in the navigation device and resumption of running can be obtained with a speed detector such as a vehicle speed sensor. Thus, the signal information providing system according to the present embodiment can use information from devices conventionally mounted on vehicles to specify a period of change of a traffic light without introducing a new apparatus and hence the system can be constructed with low cost.

Though an embodiment of the present disclosure has been described, it should be understood that the embodiment disclosed herein is illustrative and non-restrictive in every respect. The scope of the present disclosure is defined by the terms of the claims and is intended to include any modifications within the scope and meaning equivalent to the terms of the claims.

What is claimed is:

1. A traffic light information providing system for providing information on change in color of a traffic light to a vehicle, the traffic light information providing system comprising:

a vehicle; and a server configured to communicate with the vehicle, the vehicle being configured to transmit to the server, vehicle data including time information and position information of the vehicle when the vehicle resumes running from a state of stop at an intersection, the server being configured to operate and store a period of change from a red light to a green light of a traffic light provided at the intersection based on the vehicle data, and transmit information indicating timing of change of the traffic light to the green light based on the stored period of change to a vehicle which approaches the intersection, wherein the vehicle is configured to transmit the vehicle data to the server when a vehicle speed exceeds a threshold value from the state of stop at the red light at the intersection.

2. The traffic light information providing system according to claim 1, wherein the vehicle is configured to transmit the vehicle data to the server when the vehicle resumes running from a state that the vehicle is in front of vehicles which stop at the intersection.

3. The traffic light information providing system according to claim 1, wherein the server is configured to identify the traffic light based on the position information and to operate the period of change of the traffic light based on the time information accumulated for each identified traffic light.

4. The traffic light information providing system according to claim 3, wherein the server is configured to operate a predicted time of change to the green light of the traffic light based on latest time information on change to the green light of the traffic light and the operated period of change, and to transmit the predicted time to the vehicle which approaches the intersection.

5. The traffic light information providing system according to claim 3, wherein the server is configured to operate and store the period of change of the identified traffic light in accordance with at least any one category of a month, a day of a week, and a time of a day.

6. A traffic light information providing method of providing information on change in color of a traffic light in a system comprising a vehicle and a server configured to communicate with the vehicle, the traffic light information providing method comprising:

transmitting to the server, vehicle data including time information and position information of the vehicle when the vehicle resumes running from a state of stop at an intersection;

operating and storing a period of change from a red light to a green light of a traffic light provided at the intersection based on the vehicle data; and transmitting information indicating timing of change of the traffic light to the green light based on the stored period of change, to a vehicle which approaches the intersection, wherein the vehicle is configured to transmit the vehicle data to the server when a vehicle speed exceeds a threshold value from the state of stop at the red light at the intersection.

7. A server included in a traffic light information providing system for providing information on change in color of a traffic light to a vehicle, the server being configured to communicate with the vehicle, and the server being configured to receive vehicle data including time information and position information of the vehicle when the vehicle resumes running from a state of stop at an intersection and when a speed of the vehicle exceeds a threshold value from the state of stop at the intersection;

operate and store a period of change from a red light to a green light of a traffic light provided at the intersection based on the vehicle data, and transmit information indicating timing of change of the traffic light to the green light based on the stored period of change, to a vehicle which approaches the intersection.

* * * * *